US006386379B1

(12) United States Patent
Battaglia

(10) Patent No.: US 6,386,379 B1
(45) Date of Patent: May 14, 2002

(54) HANGING RACK WITH QUICK LOAD/ UNLOAD

(75) Inventor: Joseph M. Battaglia, Douglasville, GA (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/590,240

(22) Filed: Jun. 8, 2000

(51) Int. Cl.[7] ..... A47B 73/00; E06B 7/28

(52) U.S. Cl. ..... 211/106; 211/75; 211/181.1; 49/70

(58) Field of Search ..... 211/106, 74, 75, 211/181.1; 49/70

(56) References Cited

U.S. PATENT DOCUMENTS

| | | | | | |
|---|---|---|---|---|---|
| 750,063 | A | * | 1/1904 | Redding | 211/74 |
| 917,914 | A | | 4/1909 | Van Otteren | |
| 1,159,485 | A | | 11/1915 | Foster | |
| 1,236,929 | A | | 8/1917 | Hauck | |
| 1,436,515 | A | | 11/1922 | Mitchell | |
| 1,449,275 | A | | 3/1923 | Feist | |
| 1,936,517 | A | | 11/1933 | Maine | |
| 2,128,114 | A | * | 8/1938 | Benedetti | 211/75 X |
| 2,508,945 | A | | 5/1950 | Heuer | |
| 2,603,441 | A | * | 7/1952 | Emmart | 211/75 X |
| 2,741,370 | A | | 4/1956 | Dills | |
| 2,763,413 | A | | 9/1956 | Felton | |
| 3,746,179 | A | | 7/1973 | Paumgardhen | |
| 4,318,485 | A | | 3/1982 | Clement | |
| 4,327,836 | A | | 5/1982 | Okuno | |
| 5,039,046 | A | | 8/1991 | Brewster | |
| D342,844 | S | | 1/1994 | Rittenberg | |
| 5,330,261 | A | | 7/1994 | Bennett | |
| 5,351,841 | A | | 10/1994 | Belokin et al. | |
| 5,358,128 | A | | 10/1994 | Belokin et al. | |
| 5,486,044 | A | | 1/1996 | Bennett | |
| 5,695,074 | A | | 12/1997 | Wiese | |
| 5,788,093 | A | | 8/1998 | Krut | |
| D423,269 | S | * | 4/2000 | Laga et al. | D6/566 |
| RE36,827 | E | | 8/2000 | Belokin et al. | |

* cited by examiner

*Primary Examiner*—Jerry Redman
*Assistant Examiner*—Erica B. Harris
(74) *Attorney, Agent, or Firm*—Michael Best & Friedrich LLP

(57) ABSTRACT

A wire rack provides a point of purchase structure for displaying product. The product hangs from a plurality spaced parallel pairs of arms distributed along the length of the structure. The arrangement of arms and product enables the product to be stocked on or removed from the rack in any order without disturbing the remaining products on the rack. The rack may be temporarily and removably attached to a permanent structure so that a merchant may have feature sales. In a preferred embodiment, the structure may be a freezer or refrigerator and the rack may be hung over the top of a door of the freezer or refrigerator. Suction cups may be used to stabilize the position of the hanging rack or to completely support the rack when it cannot hang from a supporting structure.

13 Claims, 7 Drawing Sheets

HANGING RACK WITH QUICK LOAD/ UNLOAD

This invention relates to hanging racks especially—although not exclusively—for use in grocery stores, pharmacies, and the like, and more particularly to racks which may be quickly placed in position and then loaded and unloaded without either disturbing other objects on the rack or unbalancing on the rack.

BACKGROUND

There are many reasons why hanging racks are used in grocery stores and the like. They may add storage at point of purchase locations when all conventional space is filled. They provide an attention getting feature which helps sell certain products, especially those products which are purchased on impulse. They enable a merchant to have feature sales.

It is desirable that such hanging racks can be installed in many different locations with little effort and that they may be stocked quickly and at a minimum cost. Further, the customer should be able to remove the product from the rack with minimum effort. After the customer has removed a product, the remaining stock on the rack should not shift and the rack should be as secure as it was when it was originally stocked. Also, the rack should continue to be in balance regardless of how much product has been removed from or added to the rack and regardless of where on the rack the customer may decide to remove a product.

SUMMARY OF THE INVENTION

In keeping with an aspect of the invention, an elongated wire rack is designed to hang vertically with a series of holder/shelves for receiving product. In one embodiment, the wire rack is designed to hang over the top edge of a support such as the door of a freezer or refrigerator, a section of a shelf, or the like. In another embodiment, the wire rack may be attached to any suitable and flat surface by suction cups. The holder/shelves have a pair of arms which receive between them the neck of a soft drink bottle. The cap or a collar portion of the neck of the bottle has a diameter which is greater than the space between the arms, so that the bottle hangs from the holder.

BRIEF DESCRIPTION OF THE DRAWINGS

The invention will be best understood from the following description with the attached drawings, in which.

DETAILED DESCRIPTION OF THE INVENTION

Figure 1:
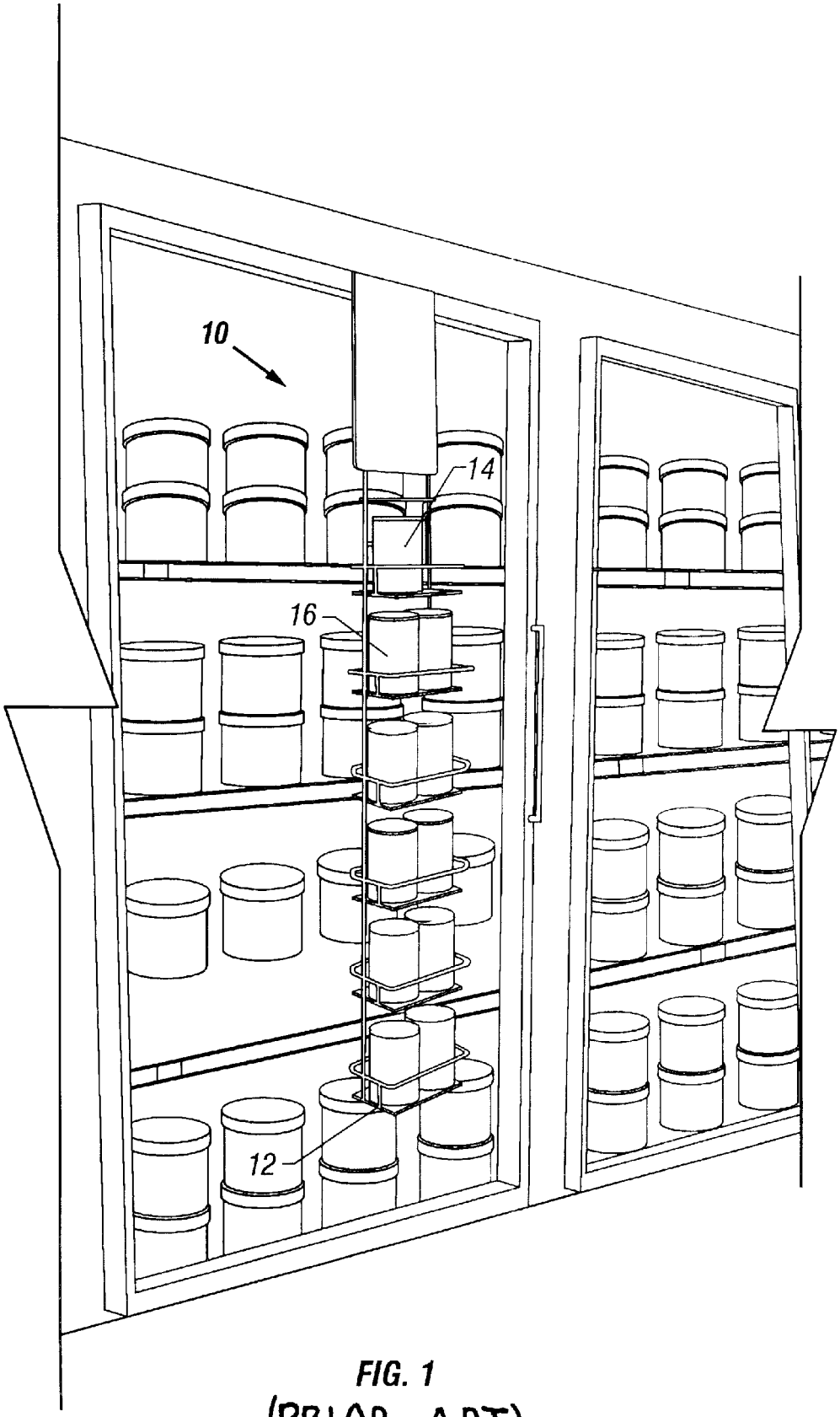
FIG. 1 (PRIOR ART)
FIG. 1 pictorially shows a prior art hanging rack subject to shortcomings solved by the invention.

FIG. 1 pictorially shows a grocery store freezer, by way of example. In this example, the freezer contains ice cream which might be sold with toppings which may be used to make sundaes. Ice cream is the kind of an item that a customer will search out to purchase. The topping is the kind of a product which will more likely be purchased if the customer finds it near the point of purchase of the ice cream. On the other hand the topping does not require freezing; therefore it would be needlessly expensive to store it in the freezer.

To place the toppings near the ice cream, a prior art hanging wire rack is hung over the top edge of the freezer door. The rack has a number of shelves 12 arranged on vertical wires, much as the rungs of a ladder are arranged on its side rails. As shown, each shelf of this prior art rack carries two jars. There is almost no vertical clearance between jars on successive shelves. Therefore, it is necessary to load the shelves beginning at the bottom and continuing upwardly toward the top. Likewise, it is necessary to remove the jars from the top down.

As here shown, a customer has removed the jar next to jar 14. This means that the next customer has the option of removing either jar 14 or jar 16. If jar 14 is removed, the hanging wire rack remains in balance. If jar 16 is removed, there are two extra jars on the right, as compared to the number of jars on the left of the rack. If enough jars are removed from one side of the rack, the prior art rack of FIG. 1 may be seriously out of balance. Also, with two jars on each shelf, they tend to support each other; however, if enough jars are standing alone on a shelf, there are destabilizing vacancies on a number of shelves as the jars slide back and forth on the shelves. Hence, they might fall off the shelf, especially if the imbalance of the prior art rack causes it to tilt.

Figure 2:
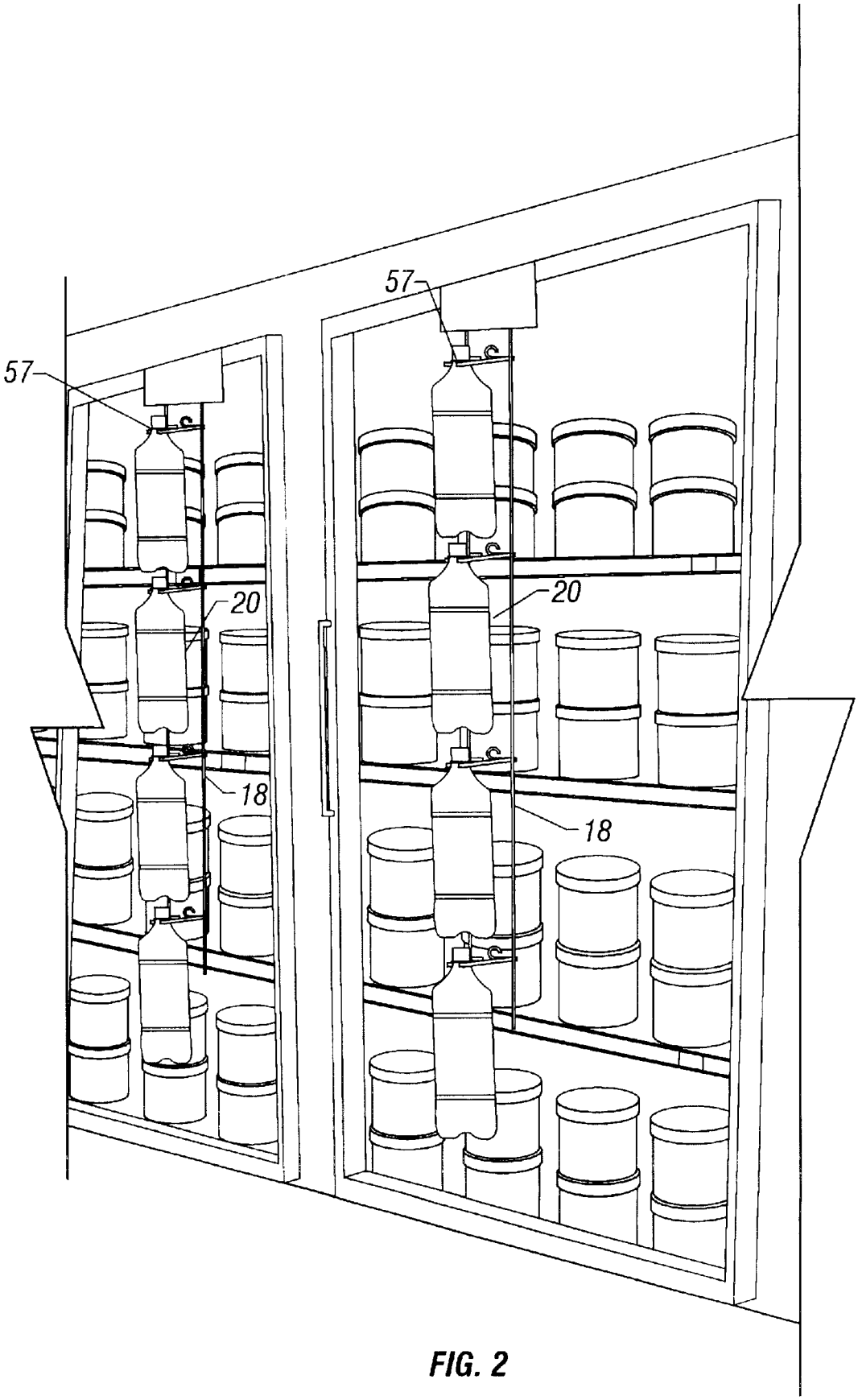
FIG. 2 pictorially illustrates the inventive hanging rack.

FIG. 2 pictorially shows one embodiment of the inventive wire rack 18, which is a ladder-like structure hanging over the top edge of a freezer door. The rack may be made All of any suitable material; however, low carbon steel is preferred. Here, the showing is of a freezer filled with frozen dinners which customers will likely seek out. The rack 18 stocks 2-liter bottles 20 of soft drinks, since it is likely that a customer looking for frozen dinners will buy a soft drink if it is displayed at the point of purchase of the frozen dinners.

One important difference between the prior art and the inventive hanging racks is that the stock person can load the inventive rack in any order, beginning at the top, at the bottom, or in the middle. The same is true of the customer who may select and remove product from any place on the rack without creating either an unbalance of the rack or a destabilizing vacancy in the rack.

Of course, the foregoing examples of ice cream, toppings, frozen dinners and soft drinks are merely illustrative of how the invention may be used. There are many other uses for the inventive racks. For example, a section of shelves may be completely full of product at a time when it is convenient to add new products which would cause a massive amount of effort to relocate previously shelved products in order to put the new product in a logical place. Or, a merchant may want to have a featured sale of a product.

Figure 3:
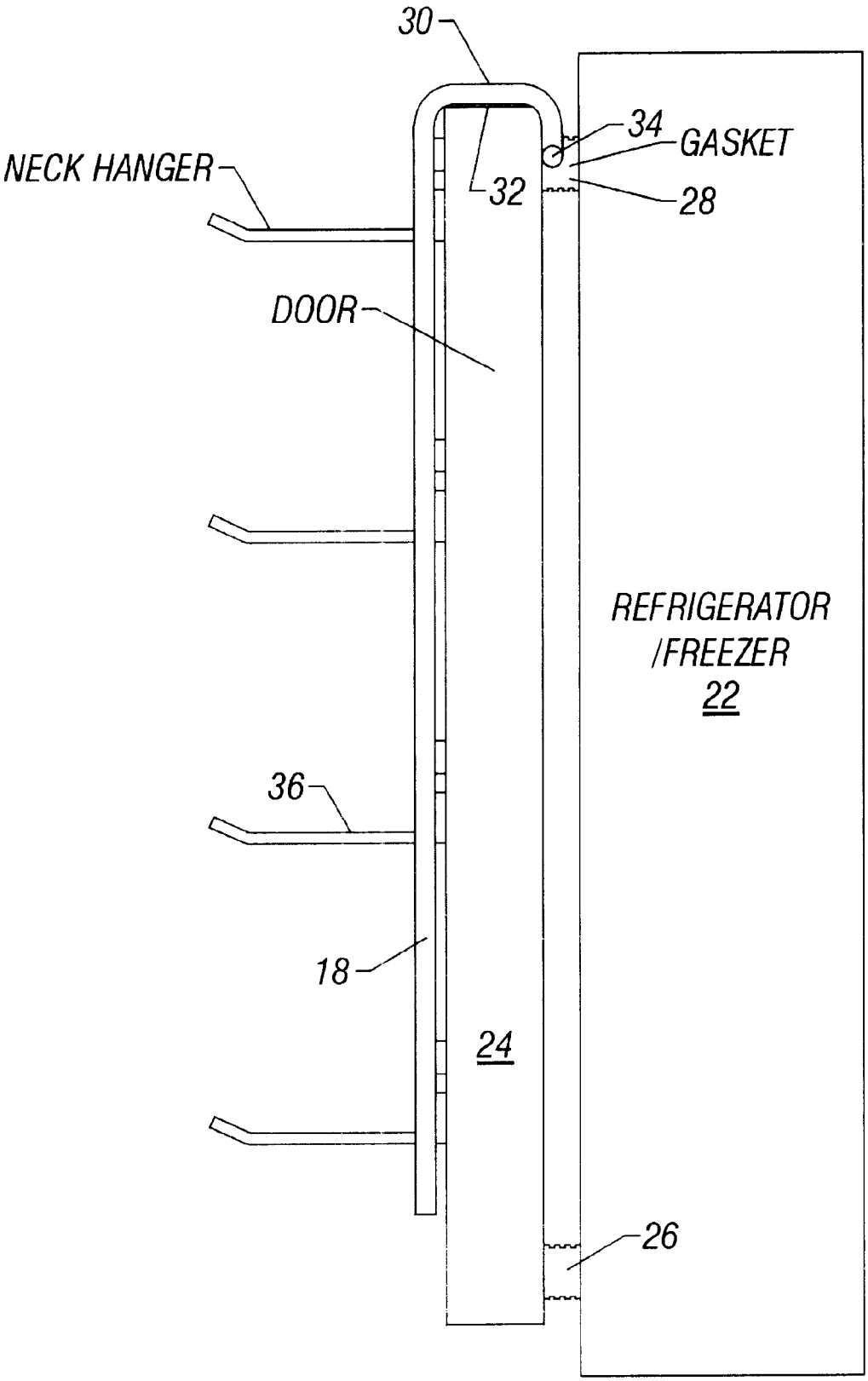
FIG. 3 schematically shows the inventive rack hanging on the door of a refrigerator or freezer, by way of example.

FIG. 3 schematically shows the inventive rack in place on a refrigerator/freezer 22 having a door 24. An elastomer gasket surrounds the opening and seals the space between the door and the cabinet of the refrigerator/freezer, as shown at the top and bottom 26, 28 of the door.

The inventive wire rack 18 has its top end bent at 30 to fit over and embrace the top edge 32 of door 24 so that the rack is installed by simply hanging it over the top edge. A small portion of the tip end 34 of bent portion 30 is captured by the elastomer of the gasket 28 in order to stabilize the position of the rack. While there is a small amount of localized distortion of the gasket at the tip end 34, the distortion is not so great as to interfere with the gasket's primary purpose of sealing the door to the cabinet.

As shown in FIG. 3, there are four holder/shelves 36, each having an outstanding pair of arms for receiving the underside of a protruding cap or collar on the necks of each of the soft drink bottles.

Figure 4:
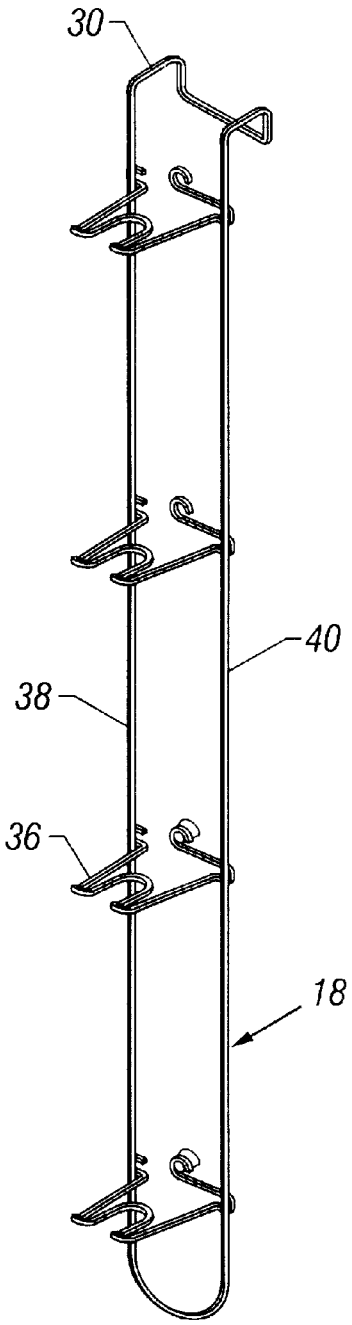
FIG. 4 is a perspective view of a first embodiment of an inventive rack.
Figure 5:
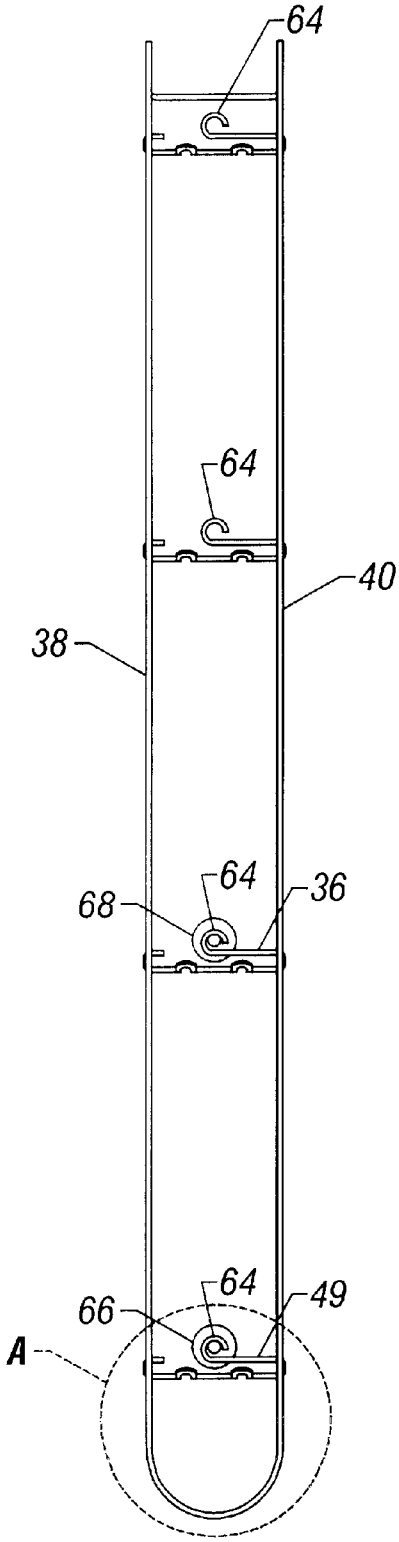
FIG. 5 is a front elevation of the rack of FIG. 4.
Figure 6:
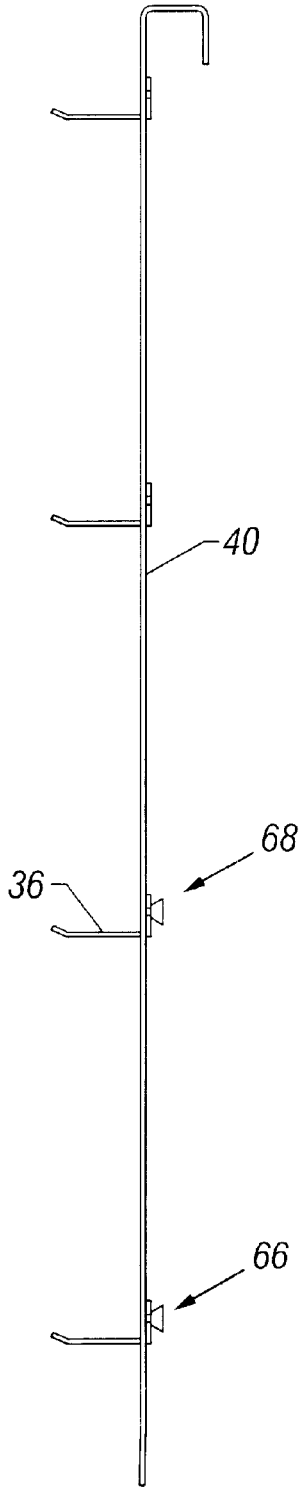
FIG. 6 is a side elevation of the rack of FIG. 4.
Figure 7:
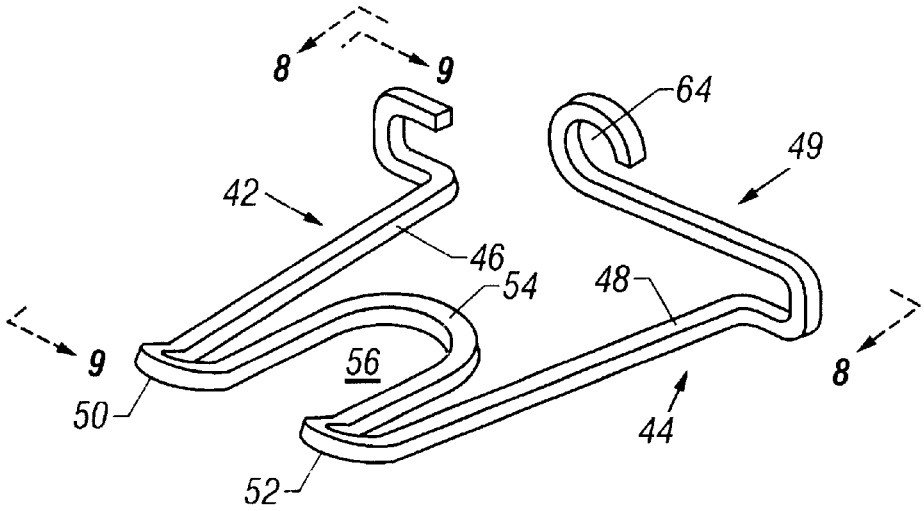
FIG. 7 is a perspective view of a single holder/ shelf.

A first embodiment of the inventive wire rack 18 is seen in FIGS. 4–6, as including two vertical wires 38, 40 providing side rails supporting four holder/shelves 36 thereon. The holder/shelves are attached to the vertical wires in a space parallel relationship in order to form a ladder-like structure. Attachment is preferably by spot welding.

The holder/shelves, themselves, are shown in FIGS. 7–10. More particularly, each holder/shelf is a continuous piece of wire bent to form two bights which are projecting arms 42, 44. Each arm has a straight section extending from an anchoring part 49 to tip ends 50, 52. From the tip ends, the wire is formed into a bight 54 defining a cove 56 having a width which easily receives the collar 57 (FIG. 2) on the neck of a 2-liter soft drink bottle, and which is too small to allow it to slip through the edges of the cove. Thus, when the neck of a bottle is slipped into the cove 56, the bottle hangs because the diameter of the collar is greater than the width of the cove.

Figure 9:
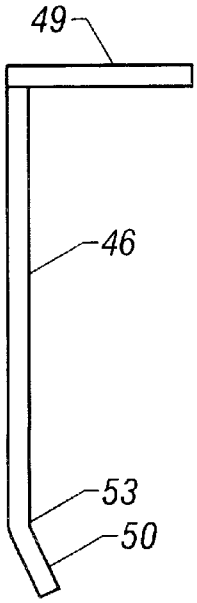
FIG. 9 is a side view of a holder/shelf taken along line 9—9 of FIG. 7.
Figure 10:
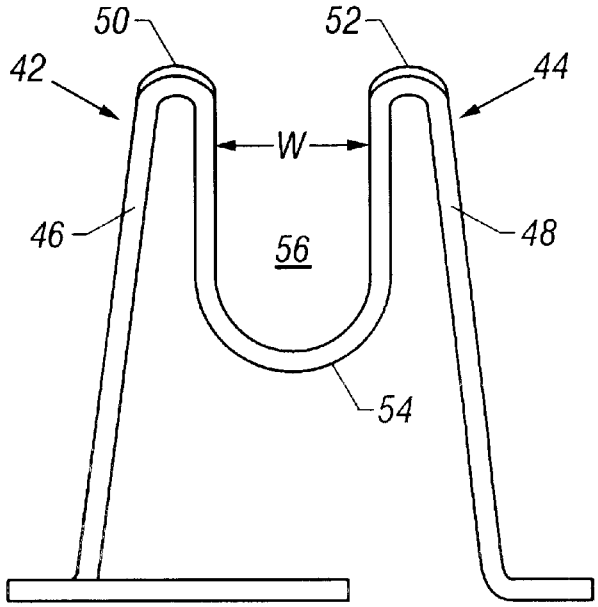
FIG. 10 is a plan view of a holder/shelf.

The tip ends 50, 52 of the arms 42, 44 are bent upwardly as shown at 53 in FIG. 9 in order to prevent the bottles from accidentally slipping off the ends of the arms, especially as the freezer door 24 opens and closes.

Figure 8:
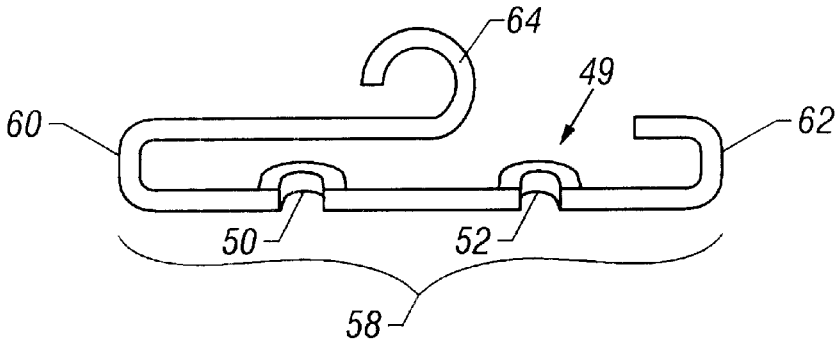
FIG. 8 is an end elevation view taken along line 8—8 of FIG. 7 and showing an anchor part of the holder/shelf.
Figure 11:
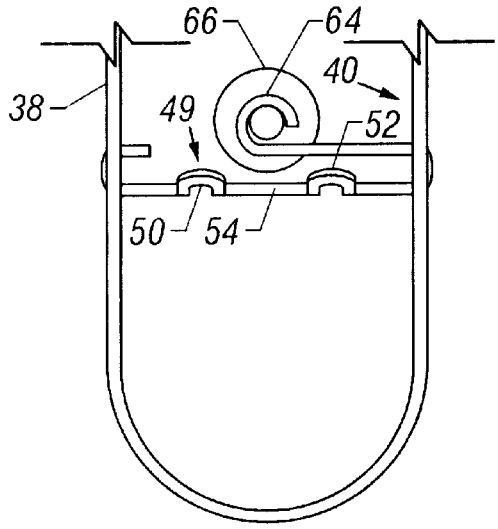
FIG. 11 shows a detail of a holder/shelf (see A in FIG. 5) attached to vertical wires of the wire rack.

The anchoring part 49 of the holder/shelf is seen in FIG. 8. Essentially, there is an elongated part 58 made of wire and having its opposite ends 60, 62 bent back upon themselves to provide a pair of wide parts, for vertical stability, which may be spot welded to side rails 38, 40. FIG. 11 illustrates detail A in FIG. 5 and shows one such holder/shelf, which is welded to the bottom of the vertical rails 38, 40.

Finally, one of the bent back ends 60 of the anchor part 49 terminates in a loop 64 dimensioned to securely receive a suction cup (not shown) that may be pressed against the glass of the freezer door in order to secure the rack in position. For the example given here where the wire frame holds four 2-liter bottles, two (seven pound pull) suction cups at 66 and 68 (FIGS. 5 and 11) provide an adequate anchoring.

Figure 12:
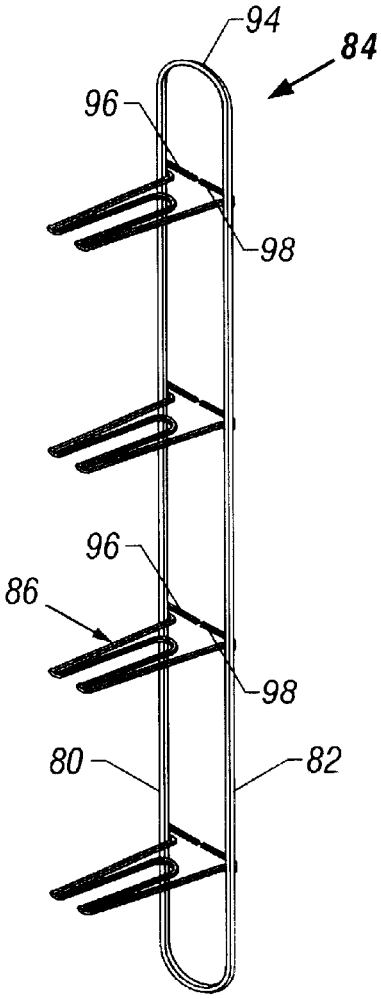
FIG. 12 is a perspective view of a second embodiment of the inventive hanging rack with the capacity for storing twice as much product as the embodiment of FIG. 4.
Figure 13:
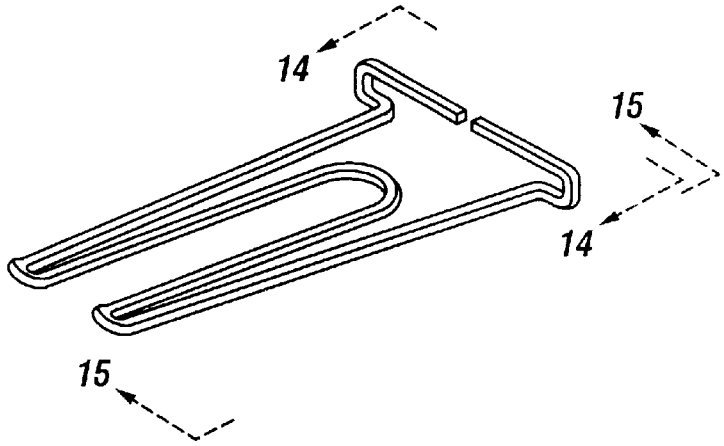
FIG. 13 is a perspective-view of a holder/shelf of the embodiment of FIG. 12.
Figure 14:
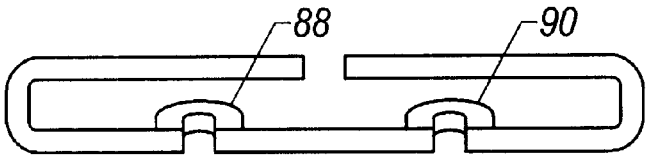
FIG. 14 is an end elevation view taken along line 14—14 of FIG. 13, and showing an anchor part for the holder/shelf.
Figure 15:
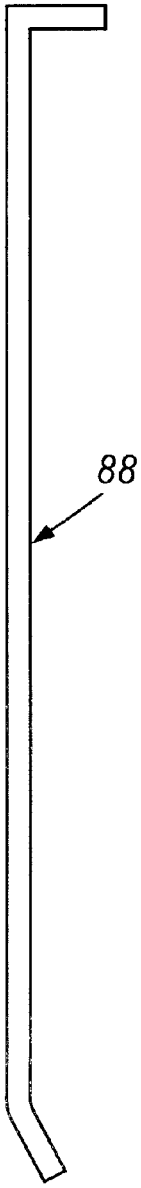
FIG. 15 is a side elevation of the holder/shelf taken along line 15—15 of FIG. 13.
Figure 16:
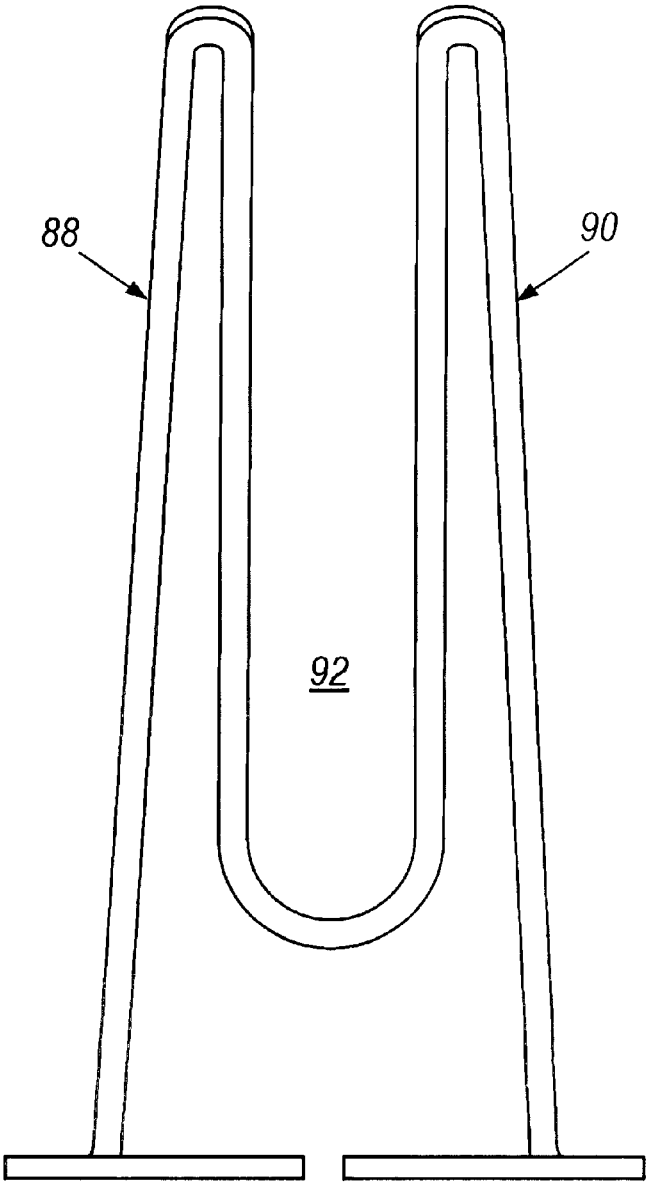
FIG. 16 is a plan view of the holder/shelf of FIG. 13.

Also, as shown in FIG. 5, each of the four holding shelves has a loop 64 so that up to four suction cups may be mounted on the rack, which is enough to support it when there is no top edge of a door, or the like, for part 30 to hang over or, when there is no hanger, as in the embodiment shown in FIG. 12.

A second embodiment of the invention is seen in FIGS. 12–16. The side rails 80, 82 form a continuous loop 84. Again, the holder/shelves 86 are spot welded to the side rails 80, 82 of loop 84.

The difference between the first and second embodiments is that the arms 88, 90 are longer than the corresponding arms 42, 44 in the first embodiment. Therefore, each cove 92 is longer than the cove 56 in the first embodiment. Accordingly, a plurality of bottles may be inserted into each of the cove 92. In the preferred arrangement of the second embodiment, the cove 92 is long enough to receive and support two 2-liter bottles. In this two bottle size, the wire rack may be mounted and secured by eight 7-pound suction cups which may be attached to frame 84 at its top 94 or, preferably along arms 96 at 98 of each of the holder/shelves in any suitable manner.

While the foregoing description has given specific examples, it should be understood that those who are skilled in the art may perceive various modifications thereof. Therefore, the appended claims are to be construed to include all equivalent structures that fall within the scope and spirit of the invention.

The claimed invention is:

1. An elongated wire rack for attachment to a door of a supporting structure and for holding at least one bottle, said rack comprising: vertical members having a plurality of holders distributed along the length of the vertical members in a spaced relationship, said vertical members being formed of wire and having top ends bent to fit over and embrace a top edge of the door of said supporting structure, each of said holders having a pair of arms extending outwardly from the vertical members, a cove being formed between said arms, said cove having a width for receiving a neck of said at least one bottle having a wide diameter portion, the width of said cove being less than that of the wide diameter portion of said at least one bottle so that the bottle may hang from the wide diameter portion when the neck is slipped into said cove, and wherein the door is on a freezer or refrigerator having an elastomer gasket between the door and the freezer or refrigerator, the gasket sealing the door to maintain the freezer or refrigerator, and said bent top ends of said vertical members being captured by the elastomer gasket to stabilize said rack without breaking the seal between the door and the freezer or refrigerator.

2. The rack of claim 1 wherein each of said holders includes means for receiving a suction cup for securing said rack in position and has an elongated anchor part that has a pair of parts that are secured to said vertical members for vertical stability, said means for receiving a suction cup being a part of said anchor part.

3. The rack of claim 2 wherein said anchor part is a wire and said means for receiving a suction cup is a loop at an end of a bent back portion of said wire.

4. A wire rack comprising an elongated ladder structure having a plurality of spaced parallel pairs of arms extending therefrom, said pairs of arms being distributed along a length of said elongated structure, each of said pairs of arms defining between them a space for receiving an object having a narrow part that fits into said space and a wide part that cannot pass through said space, said wide part of the object being above said narrow part of the object whereby the object hangs from said rack when said narrow part is in said space, and means for temporarily anchoring said ladder structure to a second and permanent structure at a point of purchase location in order to temporarily stock and display the object at the purchase location, and wherein said elongated ladder structure is made from two vertical wires with each of said pair of arms being bent wires welded to said vertical wires, said bends of said bent wires forming said space defined by outwardly projecting wires bent back upon themselves to form a pair of bights with a cove formed in the space between them, the outer tip ends of the projecting wire bights being bent upwardly to prevent the objects from accidentally sliding out of said space and falling off said arms, and said ladder structure is formed so that the object may be stored on or removed from any pair of arms on said rack without disturbing others of the objects also stored on said rack with said arms aligned so that said rack remains in balance regardless of which of the objects is removed from said rack.

5. An elongated wire rack adapted (a) to be hung from a door on a support structure wherein the door has an elastomer gasket for sealing between the door and the support structure and (b) for holding at least one bottle by its neck, the rack comprising:

a vertical member formed of wire and having a top end bent to fit over and embrace a top edge of the door, wherein the bent top end of the vertical member is captured by the elastomer gasket to stabilize the rack when the door is closed; and a plurality of holders secured to and distributed along the length of the vertical member in a spaced relationship, each of the holders having a pair of arms extending outwardly from the vertical member wherein the arms form a cove having a width for receiving and holding the neck of the at least one bottle.

6. The rack of claim 5 wherein at least one of the holders is adapted for receiving a suction cup for securing the rack to the door.

7. The rack of claim 5 wherein the arms of each holder comprise a pair of elongated parts that bend around the vertical member for securing each holder to the vertical member.

8. The rack of claim 7 further comprising a suction cup attached to one of the elongated parts for securing the rack to the door.

9. A wire rack for attaching to a support structure and holding a plurality of bottles by their necks, the rack comprising:

an elongated ladder structure made from two vertical wire segments;

a plurality of spaced parallel pairs of arms extending from the ladder structure, the pairs of arms being distributed along a length of the structure and each pair of arms being formed from a bent wire welded to the vertical wire segments, the bends of the bent wire projecting back upon themselves to form a pair of bights that define between them a cove for receiving and holding the necks of the bottles so that the plurality of bottles may be stored and removed from the pairs of arms without disturbing any of the other bottles in the rack and the rack remains in balance regardless of which of the bottles is removed from the rack;

outer ends of the wire bights bent upwardly to prevent the bottles from accidentally sliding out from the cove formed between each of the pairs of the arms; and means for temporarily anchoring the rack to the support structure.

10. The rack of claim 9 wherein the anchoring means comprises bent portions of the vertical wires to fit over a top edge of the support structure.

11. The rack of claim 10 wherein the support structure includes a door having an elastomer gasket for sealing between the door and the support structure and the bent portions of the vertical wires are captured by the elastomer gasket when the door is closed to stabilize the rack.

12. The rack of claim 10 wherein the anchoring means further comprises a suction cup disposed on one of the pairs of arms.

13. The rack of claim 9 wherein the bent wire forming each pair of arms is bent around the vertical wires of the ladder structure.

* * * * *